US009624889B2

(12) United States Patent
Hu et al.

(10) Patent No.: US 9,624,889 B2
(45) Date of Patent: Apr. 18, 2017

(54) APPARATUS AND METHOD FOR CONTROLLING RAIL PRESSURE OF HIGH-PRESSURE COMMON-RAIL TUBE CAVITY OF HIGH-PRESSURE COMMON-RAIL FUEL SYSTEM OF ENGINE

(75) Inventors: Guangdi Hu, Shandong (CN); Shaojun Sun, Shandong (CN); Dehui Tong, Shandong (CN)

(73) Assignee: Weichai Power Co., Ltd., Weifang (CN)

( * ) Notice: Subject to any disclaimer, the term of this patent is extended or adjusted under 35 U.S.C. 154(b) by 529 days.

(21) Appl. No.: 14/112,915

(22) PCT Filed: Apr. 19, 2011

(86) PCT No.: PCT/CN2011/072983
§ 371 (c)(1),
(2), (4) Date: Oct. 18, 2013

(87) PCT Pub. No.: WO2012/142742
PCT Pub. Date: Oct. 26, 2012

(65) Prior Publication Data

US 2014/0034022 A1 Feb. 6, 2014

(51) Int. Cl.
*F02M 69/50* (2006.01)
*F02D 41/38* (2006.01)
*F02D 41/14* (2006.01)

(52) U.S. Cl.
CPC ..... *F02M 69/50* (2013.01); *F02D 41/3845* (2013.01); *F02D 2041/141* (2013.01);
(Continued)

(58) Field of Classification Search
CPC ..... F02D 41/3845; F02D 2041/141; F02D 2200/0602; F02D 2041/1433;
(Continued)

(56) References Cited

U.S. PATENT DOCUMENTS

2003/0084871 A1* 5/2003 Uchiyama ..... F02D 41/221 123/339.15
2003/0106531 A1* 6/2003 Saeki ..... F02D 35/023 123/435
(Continued)

FOREIGN PATENT DOCUMENTS

JP 2004324440 A 11/2004
JP 2005301764 A 10/2005
WO WO 2009/132897 A1 11/2009

OTHER PUBLICATIONS

PCT International Search Report and Written Opinion, PCT Application No. PCT/CN2011/072983, Jan. 19, 2012, nine pages.
(Continued)

*Primary Examiner* — Hung Q Nguyen
*Assistant Examiner* — Brian P Monahon
(74) *Attorney, Agent, or Firm* — Fenwick & West LLP

(57) ABSTRACT

An apparatus (200) for controlling the rail pressure of the high-pressure common-rail tube cavity of the high-pressure common-rail fuel system of an engine, comprising an operation condition acquiring device (202), which is used for acquiring operation conditions associated with the high-pressure common-rail fuel system of the engine; a fuel quantity metering valve equivalent cross-sectional area determining device (204) coupled with the operation condition acquiring device (202), which is used for determining an equivalent cross-sectional area of the fuel quantity metering valve (210) by a linear physical model (212) of fuel quantity metering valve equivalent cross-sectional area based on an acquired operation condition and a target value of the rail pressure of the high-pressure common-rail tube cavity; a signal generating device (206) coupled with the fuel quantity metering valve equivalent cross-sectional area determining device (204), which used for generating a driving signal (208) for controlling the equivalent cross-
(Continued)

sectional area of the fuel quantity metering valve (210) based on the determined fuel quantity metering valve equivalent cross-sectional area. The apparatus can control the rail pressure of the high-pressure common-rail tube cavity precisely. A method for controlling the rail pressure of the high-pressure common-rail tube cavity of the high-pressure common-rail fuel system of an engine is also disclosed. An apparatus and a method for observing fuel pressure are further disclosed.

12 Claims, 5 Drawing Sheets

(52) U.S. Cl.
CPC ..... *F02D 2041/1433* (2013.01); *F02D 2200/0602* (2013.01)

(58) Field of Classification Search
CPC .... F02D 22/5004; F02M 69/50; F02M 69/52; F02M 2700/137; F02M 2700/1376; F02M 7/18; F02M 19/02; F02M 19/0207; F02M 22/5004; F02M 41/1427; F02M 65/003; F02M 69/18
See application file for complete search history.

(56) References Cited

U.S. PATENT DOCUMENTS

2006/0147317 A1* 7/2006 Okamoto ..... F02D 41/3845 417/297
2009/0150046 A1* 6/2009 Achleitner ..... F02D 41/22 701/103
2011/0036329 A1 2/2011 Jung et al.

OTHER PUBLICATIONS

PCT International Preliminary Report on Patentability, PCT Application No. PCT/CN2011/072983, Oct. 22, 2013, six pages.

* cited by examiner

APPARATUS AND METHOD FOR CONTROLLING RAIL PRESSURE OF HIGH-PRESSURE COMMON-RAIL TUBE CAVITY OF HIGH-PRESSURE COMMON-RAIL FUEL SYSTEM OF ENGINE

FIELD OF THE INVENTION

Embodiments of the present invention generally relate to the field of engines, and more specifically to an apparatus and method for controlling a rail pressure of a high-pressure common-rail tube cavity of a high-pressure common-rail fuel system of an engine.

BACKGROUND OF THE INVENTION

A fuel pressure in the high-pressure common-rail fuel system of the engine in the prior art is controlled by employing a PID (Proportion Integration Differentiation) type control policy, which requires a lot of calibration work. Besides, by employing such conventional control policy of the high-pressure common-rail fuel system of the engine, there is a larger deviation between an actual measurement value of the fuel pressure in the high-pressure common-rail tube cavity and a target value of the fuel pressure under some operation conditions of the engine, which causes occurrence of a larger error between the actual fuel injection amount in the high-pressure common-rail fuel system of the engine and a target fuel injection amount, which directly affects consistency of the power of the engine and fuel injection in respective cylinders.

Therefore, development of an advanced fuel pressure control policy of the high-pressure common-rail fuel system of the engine is crucial for improvement of the engine performance and reduction of the calibration work of an electronic control unit.

SUMMARY OF THE INVENTION

Since such precise control policy does not exist in the prior art, the present invention provides an apparatus and method for controlling a rail pressure of a high-pressure common-rail tube cavity of a high-pressure common-rail fuel system of an engine, to at least partly solve the above problems.

According to one aspect of the present invention, embodiments of the present invention provide an apparatus for controlling a rail pressure of a high-pressure common-rail tube cavity of a high-pressure common-rail fuel system of an engine. The apparatus may comprise an operation condition acquiring device configured to acquire operation conditions associated with the high-pressure common-rail fuel system of the engine; a fuel quantity metering valve equivalent cross-sectional area determining device coupled to the operation condition acquiring device and configured to determine an equivalent cross-sectional area of a fuel quantity metering valve by using a linear physical model of fuel quantity metering valve equivalent cross-sectional area based on the acquired operation condition and a target value of the rail pressure of the high-pressure common-rail tube cavity; a signal generating device coupled to the fuel quantity metering valve equivalent cross-sectional area determining device and configured to generate a driving signal for controlling the equivalent cross-sectional area of the fuel quantity metering valve based on the determined equivalent cross-sectional area of the fuel quantity metering valve.

According to some embodiments of the present invention, the operation conditions may comprise a lift of a plunger of a high pressure fuel injection pump and a measurement value of its linear speed.

According to some embodiments of the present invention, the operation conditions may comprise an actual rail pressure measurement value of the high-pressure common-rail tube cavity.

According to some embodiments of the present invention, the linear physical model may be related to the high-pressure common-rail fuel system of the engine in the following one or more aspects: a volume of the plunger pump cavity, a fuel elastic modulus of the plunger pump cavity, an observation value of the fuel pressure of the plunger pump cavity at a balance point, a fuel supply pressure of a low-pressure fuel pump, a flow coefficient of the flow metering unit, the equivalent cross-sectional area of the fuel quantity metering valve, a fuel density, a check valve flow coefficient from the plunger pump cavity to the high-pressure common-rail tube cavity, the equivalent cross-sectional area of a check valve from the plunger pump cavity to the high-pressure common-rail tube cavity, a rail pressure measurement value of the high-pressure common-rail tube cavity or a rail pressure observation value of the high-pressure common-rail tube cavity at the balance point, a cross-sectional area of the plunger pump cavity, a plunger movement linear speed, a fuel elastic modulus in the high-pressure common-rail tube cavity, a volume of the high-pressure common-rail tube cavity, the flow coefficient of a fuel injector, the equivalent cross-sectional area of the fuel injector, and a pressure of compressed air in the cylinder.

According to further embodiments of the present invention, the linear physical model may be related to the high-pressure common-rail fuel system of the engine in the following one or more aspects: a volume of the plunger pump cavity, a fuel elastic modulus of the plunger pump cavity, an observation value of the fuel pressure of the plunger pump cavity at a balance point, a fuel supply pressure of a low-pressure fuel pump, a flow coefficient of the flow metering unit, a fuel density, a check valve flow coefficient from the plunger pump cavity to the high-pressure common-rail tube cavity, the equivalent cross-sectional area of a check valve from the plunger pump cavity to the high-pressure common-rail tube cavity, a rail pressure measurement value of the high-pressure common-rail tube cavity or a rail pressure observation value of the high-pressure common-rail tube cavity at the balance point, a fuel elastic modulus in the high-pressure common-rail tube cavity, and a volume of the high-pressure common-rail tube cavity.

According to some embodiments of the present invention, the volume of the plunger pump cavity may be related to a maximum volume of the plunger pump cavity and a plunger lift relevant to a camshaft rotation angle; the plunger movement linear speed may be related to a lift of the high-pressure fuel injection pump plunger, the camshaft rotation angle and a camshaft rotation speed; the observation value of the fuel pressure of the plunger pump cavity at the balance point may be related to a measurement value of the fuel pressure in the high-pressure common-rail tube cavity at the balance point, the equivalent cross-sectional area of the fuel quantity metering valve, the lift of the high-pressure fuel injection pump plunger and the plunger movement linear speed.

According to another aspect of the present invention, embodiments of the present invention provide an apparatus for observing the fuel pressure, the observing apparatus comprising: a parameter acquiring device configured to acquire the plunger movement linear speed, a lift of the high-pressure fuel injection pump plunger, the equivalent cross-sectional area of the fuel quantity metering valve and the measurement value of the rail pressure of the high-pressure common-rail tube cavity; a fuel pressure observation value determining device coupled to the parameter acquiring device and configured to, based on the acquired measurement value, determine the observation value of the plunger pump cavity fuel pressure by using the linear models of both the observation value of the fuel pressure of the plunger pump cavity and the observation value of the rail pressure of the high-pressure common-rail tube cavity; and a communication device which is coupled to the fuel pressure observation value determining device and configured to provide the observation value for use by the linear physical model of the equivalent cross-sectional area of the fuel quantity metering valve.

According to an embodiment of the present invention, the fuel pressure observation value determining device is further configured to, based on the acquired measurement value, determine the observation value of the rail pressure of the high-pressure common rail tube cavity by using the linear models of both the observation value of the fuel pressure of the plunger pump cavity and the observation value of the rail pressure of the high-pressure common-rail tube cavity.

According to a further aspect of the present invention, embodiments of the present invention provide a method for controlling the rail pressure of the high-pressure common-rail tube cavity of the high-pressure common-rail fuel system of the engine. The method may comprise: acquiring operation conditions associated with the high-pressure common-rail fuel system of the engine; determining an equivalent cross-sectional area of a fuel quantity metering valve by using a linear physical model of fuel quantity metering valve equivalent cross-sectional area based on the acquired operation condition and a target value of the rail pressure of the high-pressure common-rail tube cavity; generating a driving signal for controlling the equivalent cross-sectional area of the fuel quantity metering valve based on the determined fuel quantity metering valve equivalent cross-sectional area.

According to some embodiments of the present invention, the operation conditions may comprise a lift of a high pressure fuel injection pump plunger and a measurement value of its linear speed.

According to some embodiments of the present invention, the operation conditions may comprise an actual rail pressure measurement value of the high-pressure common-rail tube cavity.

According to some embodiments of the present invention, the linear physical model may be related to the high-pressure common-rail fuel system of the engine in the following one or more aspects: a volume of the plunger pump cavity, the elastic modulus of the fuel in the plunger pump cavity, an observation value of the fuel pressure in the plunger pump cavity at a balance point, a fuel supply pressure of a low-pressure fuel pump, a flow coefficient of the flow metering unit, the fuel quantity metering valve equivalent cross-sectional area, a fuel density, a check valve flow coefficient from the plunger pump cavity to the high-pressure common-rail tube cavity, the equivalent cross-sectional area of the check valve from the plunger pump cavity to the high-pressure common-rail tube cavity, a rail pressure measurement value of the high-pressure common-rail tube cavity or a rail pressure observation value of the high-pressure common-rail tube cavity at the balance point, a cross-sectional area of the plunger pump cavity, a plunger movement linear speed, a fuel elastic modulus in the high-pressure common-rail tube cavity, a volume of the high-pressure common-rail tube cavity, a fuel injector flow coefficient, a fuel injector equivalent cross-sectional area, and a pressure of compressed air in the cylinder.

According to further embodiments of the present invention, the linear physical model may be related to the high-pressure common-rail fuel system of the engine in the following one or more aspects: a volume of the plunger pump cavity, the elastic modulus of the fuel in the plunger pump cavity, an observation value of the fuel pressure of the plunger pump cavity at a balance point, a fuel supply pressure of a low-pressure fuel pump, a flow coefficient of the flow metering unit, a fuel density, a check valve flow coefficient from the plunger pump cavity to the high-pressure common-rail tube cavity, the equivalent cross-sectional area of the check valve from the plunger pump cavity to the high-pressure common-rail tube cavity, a rail pressure measurement value of the high-pressure common-rail tube cavity or a rail pressure observation value of the high-pressure common-rail tube cavity at the balance point, the elastic modulus of the fuel in the high-pressure common-rail tube cavity, and a volume of the high-pressure common-rail tube cavity.

According to some embodiments of the present invention, the volume of the plunger pump cavity may be related to a maximum volume of the plunger pump cavity and a plunger lift relevant to a camshaft rotation angle; the plunger movement linear speed may be related to a lift of the high-pressure fuel injection pump plunger, the camshaft rotation angle and a camshaft rotation speed; the observation value of the fuel pressure in the plunger pump cavity at the balance point may be related to a measurement value of the fuel pressure in the high-pressure common-rail tube cavity at the balance point, the equivalent cross-sectional area of the fuel quantity metering valve, the lift of the high-pressure fuel injection pump plunger and the plunger movement linear speed.

According to another aspect of the present invention, embodiments of the present invention provide a method for observing a fuel pressure, the method comprising: acquiring the plunger movement linear speed, a lift of the high-pressure fuel injection pump plunger, the equivalent cross-sectional area of the fuel quantity metering valve and the measurement value of the rail pressure of the high-pressure common-rail tube cavity; based on the acquired measurement value, determining the observation value of the plunger pump cavity fuel pressure by using the linear model of both the fuel pressure observation value of the plunger pump cavity and the observation value of the rail pressure of the high-pressure common-rail tube cavity; and providing the observation value for use by the linear physical model of the fuel quantity metering valve equivalent cross-sectional area.

According to some embodiments of the present invention, the step of acquiring the measurement value further comprises determining the observation value of the rail pressure of the high-pressure common-rail tube cavity by using the linear model of both the observation value of the fuel pressure of the plunger pump cavity and the observation value of the rail pressure of the high-pressure common-rail tube cavity.

By using many linear physical models provided by embodiments of the present invention, the rail pressure of the high-pressure common-rail tube cavity may be better controlled so that it approaches its target value under any operation conditions. Besides, since the physical model indicative of relationship between respective device in the high-pressure common-rail fuel system of the engine is provided by the present invention, calibration work of the electronic control unit can be reduced.

BRIEF DESCRIPTION OF DRAWINGS

The above and other objects, features and advantages of embodiments of the present invention will become more apparent through detailed description with reference to the accompanying drawings. In the figures, several embodiments of the present invention are illustrated in an exemplary but non-restrictive manner.

In the figures, identical or corresponding reference numbers designate identical or corresponding portions.

DETAILED DESCRIPTION OF PREFERRED EMBODIMENTS

The principles and spirit of the present invention will be described hereunder with reference to several exemplary embodiments. It should be appreciated that provision of these embodiments is only to enable those skilled in the art to better understand and further implement the present invention, not intended for limiting the scope of the present invention in any manner.

According to embodiments of the present invention, there is provided an apparatus and method for controlling a rail pressure of a high-pressure common-rail tube cavity of a high-pressure common-rail fuel system of an engine. Besides, there is further provided an apparatus and method for observing a fuel pressure to collaborate with the apparatus and method for controlling the rail pressure.

Additionally, the term "parameter" used herein indicates the value of any physical quantity that can indicate a (target or actual) physical state or operation condition of the engine. Moreover, in the context of this specification, a "parameter" may be used interchangeably with the physical quantity represented thereby. For example, "a parameter indicating a camshaft rotation speed" has an equivalent meaning herein with "camshaft rotation speed." Moreover, in this specification, suppose P denotes a given physical quantity, then $\dot{P}$ denotes a derivative of P with respect to time, i.e., P's change ratio along with time; $\hat{P}$ denotes an observed value of the physical quantity P, namely, a measurement value after filtering is performed (the measurement value includes noise).

Besides, the term "acquire" used herein includes various currently known or future developed device, for example, measuring, reading, estimating, predicting etc.; the term "measure" used here includes various currently known or future developed device, for example, directly measuring, reading, computing, estimating, etc.

Then, reference is first made to several typical embodiments of the present invention to illustrate the principles and spirit of the present invention in detail.

Figure 1:
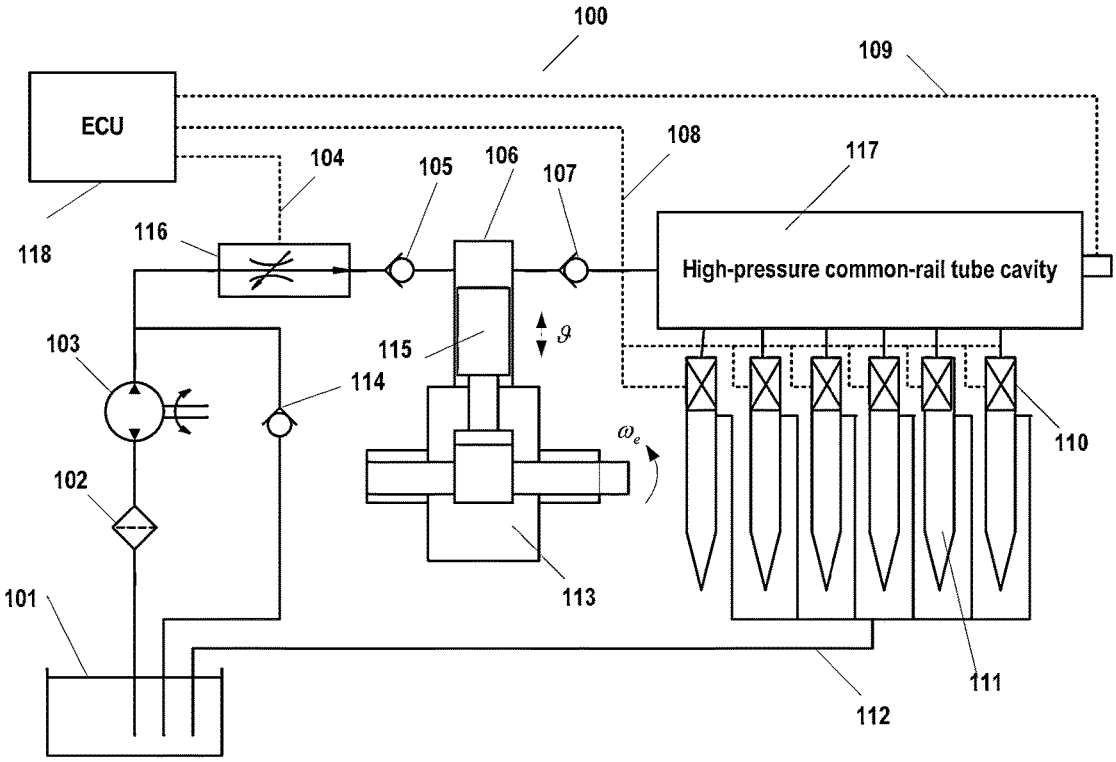
FIG. 1 illustrates a schematic view of a high-pressure common-rail fuel system of an engine in which a flow metering unit is located in a low-pressure fuel circuit.

First referring to FIG. 1, as stated above, FIG. 1 illustrates a schematic view of a high-pressure common-rail fuel system 100 of an engine in which a flow metering unit is located in a low-pressure fuel circuit. It shall be appreciated that FIG. 1 only illustrates portions of the high-pressure common-rail fuel system 100 relevant to embodiments of the present invention, and the high-pressure common-rail fuel system 100 may further comprise any number of other parts.

As shown in FIG. 1, the high-pressure common-rail fuel system 100 of the engine comprises: a fuel tank 101, a fuel filter 102, a fuel low-pressure fuel pump 103, a fuel flow metering unit 116, which comprises a fuel quantity metering valve (e.g., an electromagnetic valve) configured to control quantity of fuel flowing into the high-pressure common-rail tube cavity 117 therethrough by changing its equivalent cross-sectional area; a check valve 105 configured to serve as a one-way fuel path from the fuel flow metering unit to a plunger pump cavity 106; a high pressure fuel injection pump 113 comprising a high pressure fuel injection pump plunger 115 and a plunger pump cavity 106, wherein driven by a cam shaft, the high pressure fuel injection pump plunger 115 reciprocatingly moves in the plunger pump cavity 106; when the high pressure fuel injection pump plunger 115 moves downwardly, vacuum is formed in the plunger pump cavity 106, whereby the fuel is sucked in through the check valve 105; when the high pressure fuel injection pump plunger 115 moves upwardly, the fuel in the plunger pump cavity 106, being pressurized, forms high-pressure fuel which is pressed into the high-pressure common-rail tube cavity 117 when the fuel pressure is greater than a fuel pressure in the high-pressure common-rail tube cavity 117; the check valve 107 is configured to serve as a one-way path of the high-pressure fuel from the plunger pump cavity 106 to the high-pressure common-rail tube cavity 117; the high-pressure common-rail tube cavity 117, configured to store high-pressure fuel; a fuel injector 111, which driven by a fuel injector driving electromagnetic valve 110, injects the high-pressure fuel stored in the high-pressure common-rail tube cavity 117 into respective cylinders; and an electronic control unit (ECU) 118, configured to provide a drive signal (e.g., a drive signal 114 of the fuel quantity metering valve and a drive signal 108 of the injector electromagnetic valve) for controlling openness of the fuel quantity metering valve of the fuel flow metering unit (namely, equivalent cross-sectional area), and the injector drive electromagnetic valve 110 (namely, opening and closing) and the like.

As can be seen in FIG. 1, since the high-pressure common-rail fuel system 100 of the engine comprises so many parts and operation conditions are complicated, it is very difficult to precisely control the rail pressure in the high-pressure common-rail tube cavity 117 by controlling the equivalent cross-sectional area of the fuel quantity metering valve. Hence, to solve such technical problem, the present invention is concerned with characterization and model building of the fuel flow and/or pressure of the fuel quality metering valve, the high-pressure fuel injection pump, the high-pressure common-rail tube cavity, and the fuel injector, thereby achieving effective control which is impossible in the prior art. To this end, as stated in detail hereunder, embodiments of the present invention build a linear model of the above physical quantities and use them to control the rail pressure in the high-pressure common-rail tube cavity 117.

Figure 2:
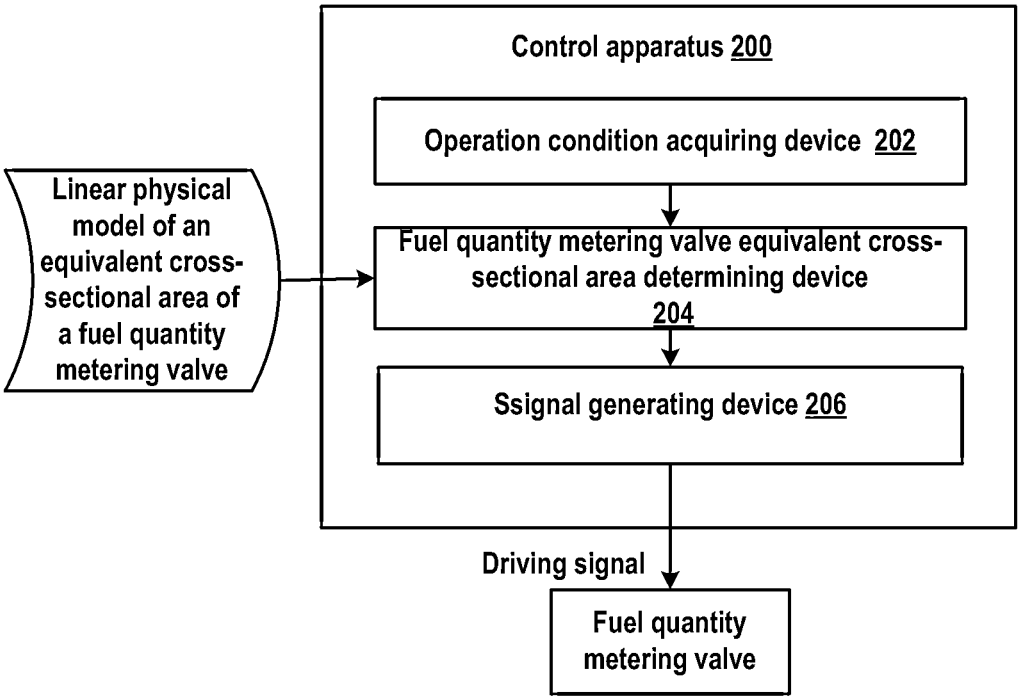
FIG. 2 illustrates a block diagram an apparatus for controlling a rail pressure of a high-pressure common-rail tube cavity of a high-pressure common-rail fuel system of an engine according to an embodiment of the present invention.

Hereunder, reference is made to FIG. 2 to describe an apparatus 200 for controlling a rail pressure of a high-pressure common-rail tube cavity of a high-pressure common-rail fuel system of an engine.

Those skilled in the art can understand a control apparatus 200 shown in FIG. 2 may be put into practice as the electronic control unit 118 or a part thereof shown in FIG. 1. Alternatively, the control apparatus 200 may be implemented as an individual control apparatus.

As shown in FIG. 2, the control apparatus 200 comprises an operation condition acquiring device 202, which is used for acquiring operation conditions associated with the high-pressure common-rail fuel system of the engine.

According to some embodiments of the present invention, the operation conditions may comprise a lift of the high pressure fuel injection pump plunger and a measurement value of its linear speed (respectively represented by h and θ).

According to some other embodiments of the present invention, the operation conditions may comprise an actual rail pressure measurement value (represented by $P_r$) of the high-pressure common-rail tube cavity.

It should be appreciated that the above operation conditions are only examples, and these operation conditions may be used in combination (for example, including the three operation conditions h, θ and $P_r$) or may include any other unmentioned operation conditions. The present invention is not limited in these aspects.

It should be appreciated that the operation condition acquiring device 202 may acquire operation conditions (e.g., direct measurement $P_r$) associated with the high-pressure common-rail fuel system of the engine through actual measurement. Alternatively or additionally, the operation condition acquiring device 202 may acquire operation conditions indicative of association with the high-pressure common-rail fuel system of the engine through predicting, estimation or calculation according to operation conditions of other parts (e.g., h is a function of a camshaft rotation angle θ and can be calculated through the camshaft rotation angle θ). The present invention is not limited in this aspect.

As shown in FIG. 2, according to an embodiment of the present invention, the control apparatus 200 may further comprise a fuel quantity metering valve equivalent cross-sectional area determining device 204 coupled with the operation condition acquiring device 202 and configured to determine an equivalent cross-sectional area (represented by u) of a fuel quantity metering valve by a linear physical model of fuel quantity metering valve equivalent cross-sectional area based on the acquired operation condition (h, θ and/or $P_r$) and a target value (represented by $P_{r,des}$ which may be set in real time according to engine operation conditions) of the rail pressure of the high-pressure common-rail tube cavity.

As can be seen from the above, according to an embodiment of the present invention, the fuel quantity metering valve equivalent cross-sectional area determining device 204 determines a fuel quantity metering valve equivalent cross-sectional area meeting $P_{r,des}$, by using the liner physical model characterizing the fuel quantity metering valve equivalent cross-sectional area, with h, θ and/or $P_r$ acquired by the operation condition acquiring device as input. In fact, in the technical field there has not been prior art technology attempting to characterize and control the fuel quantity metering valve equivalent cross-sectional area by device of such control-oriented linear physical model. The linear physical model of the fuel quantity metering valve equivalent cross-sectional area according to the embodiment of the present invention will be introduced in detail.

According to some embodiments of the present invention, the linear physical model may be related to the high-pressure common-rail fuel system of the engine in the following one or more aspects. The so-called "aspect" here comprises intrinsic properties of the high-pressure common-rail fuel system of the engine as well as real-time operation conditions during operation, for example, including but not being limited to the following: a volume of the plunger pump cavity, the elastic modulus of the fuel in the plunger pump cavity, an observation value of the fuel pressure in the plunger pump cavity at a balance point, a fuel supply pressure of a low-pressure fuel pump, a flow coefficient of the flow metering unit, the equivalent cross-sectional area of the fuel quantity metering valve, a fuel density, a check valve flow coefficient from the plunger pump cavity to the high-pressure common-rail tube cavity, the equivalent cross-sectional area of the check valve from the plunger pump cavity to the high-pressure common-rail tube cavity, a rail pressure measurement value of the high-pressure common-rail tube cavity or a rail pressure observation value of the high-pressure common-rail tube cavity at the balance point, a plunger pump cavity cross-sectional area, a plunger movement linear speed, the elastic modulus of the fuel in the high-pressure common-rail tube cavity, a volume of the high-pressure common-rail tube cavity, an injector flow coefficient, an injector equivalent cross-sectional area, and compressed air pressure in the cylinder.

According to further embodiments of the present invention, the linear physical model may be related to the high-pressure common-rail fuel system of the engine in the following one or more aspects: a volume of the plunger pump cavity, the elastic modulus of the fuel in the plunger pump cavity, an observation value of the fuel pressure of the plunger pump cavity at a balance point, a fuel supply pressure of a low-pressure fuel pump, a flow coefficient of the flow metering unit, a fuel density, a check valve flow coefficient from the plunger pump cavity to the high-pressure common-rail tube cavity, the equivalent cross-sectional area of the check valve from the plunger pump cavity to the high-pressure common-rail tube cavity, a rail pressure measurement value of the high-pressure common-rail tube cavity or a rail pressure observation value of the high-pressure common-rail tube cavity at the balance point, the elastic modulus of the fuel in the high-pressure common-rail tube cavity, and a volume of the high-pressure common-rail tube cavity.

The volume of the plunger pump cavity may be related to a maximum volume of the plunger pump cavity and a plunger lift relevant to the camshaft rotation angle; the plunger movement linear speed may be related to a lift of the high-pressure fuel injection pump plunger, the camshaft rotation angle and a camshaft rotation speed; the observation value of the fuel pressure of the plunger pump cavity at the balance point may be related to a measurement value of the fuel pressure in the high-pressure common-rail tube cavity at the balance point, the equivalent cross-sectional area of the fuel quantity metering valve, the lift of the high-pressure fuel injection pump plunger and the plunger movement linear speed.

According to embodiments of the present invention, various device may be employed to build the linear physical model of the fuel quantity metering valve equivalent cross-sectional area. Only one of said embodiments is described below.

First, a model is built for the flow of the flow metering unit, the plunger pump cavity pressure, a flow from the plunger pump cavity to the high-pressure common-rail tube cavity, the rail pressure of the high-pressure common-rail tube cavity, and a flow injected by the fuel injector to the cylinder.

As known by those skilled in the art, in order to consider major physical relations between the main mechanical, hydraulic and control parts of the high-pressure common-rail fuel system, and meanwhile determine the equivalent cross-sectional area of the fuel quantity metering valve by using the given model design, the following assumption is made in the text: 1) neglect fuel leakage of the high-pressure common-rail system; 2) the flow metering unit uses the fuel quantity metering valve (e.g., a proportional electromagnetic valve) for driving; 3) neglect an influence exerted by changes of temperature and fuel pressure on the fuel density; 4) the fuel flow coefficient does not vary with the changes of the temperature and pressure; 5) the fuel elastic modulus does not vary with the temperature. As those skilled in the art know, the above assumption is a common mode of neglecting secondary contradictions and solving primary contradictions upon building a model.

1. Building the Model 1.1 Flow Metering Unit $$Q_u = C_u u\sqrt{\frac{2(P_u - P_p)}{\rho}} \tag{1.1}$$

Wherein:

$Q_u$: a fuel flow flowing into the plunger pump cavity $C_u$: a flow coefficient (constant) of the flow metering unit u: a flow metering valve equivalent cross-sectional area of the flow metering unit, serving as a control quantity ρ: a fuel density (constant)

$P_u$: a fuel supply pressure of the low-pressure fuel pump (constant)

$P_p$: a fuel pressure in the plunger pump cavity 1.2 Plunger Pump Cavity Pressure $$\dot{P}_p = \frac{\beta_p}{V_p}(Q_u - Q_r + A_p\theta) \tag{1.2}$$

wherein:

$Q_r$: a flow from the plunger pump cavity into the high-pressure common-rail cavity $\beta_F$: the elastic modulus of the fuel in the plunger pump cavity, $\beta_F=\beta_F(P_p)$, wherein $\beta_F(P_p)$ is a polynomial of $P_p$.

$V_p$: a volume of the plunger pump cavity, $V_p=V_{max}-A_p h(\theta)$, wherein $A_p$ is a plunger pump cavity cross-sectional area, $h(\theta)$ is a plunger lift, and θ is a camshaft rotation angle.

ρ: a fuel density (constant)

$P_p$: a fuel pressure in the plunger pump cavity

θ: a plunger movement linear speed, as a function of a rotation speed of the diesel engine.

$$\vartheta = \omega_c \frac{dh(\theta)}{d\theta},$$

$\omega_c$ is a rotation speed of the fuel pump camshaft.

1.3 A Flow from the Plunger Pump Cavity into the High-Pressure Common-Rail Cavity $$Q_r = C_r A_r\sqrt{\frac{2(P_p - P_r)}{\rho}} \tag{1.3}$$

$C_r$: the flow coefficient (constant) of the check valve from the plunger pump cavity to the high-pressure common-rail tube cavity $A_r$: the equivalent cross-sectional area (constant) of the check valve from the plunger pump cavity to the high-pressure common-rail tube cavity 1.4 Fuel pressure in the high-pressure common-rail tube cavity $$\dot{P}_r = \frac{\beta_r}{V_r}(Q_r - Q_{inj}) \tag{1.4}$$

Wherein:

$Q_{inj}$: a flow injected by the injector into the cylinder $\beta_r$: the elastic modulus of the fuel in the high-pressure common-rail tube cavity, $\beta_F=\beta_F(P_p)$, wherein $\beta_F(P_p)$ is a polynomial of $P_p$.

$V_r$: a volume of the high-pressure common-rail tube cavity (constant)

$P_p$: a fuel pressure in the high-pressure common-rail tube cavity 1.5 A flow injected by the fuel injector into the cylinder $$Q_{inh} = C_{inj} A_{inj}\sqrt{\frac{2(P_r - P_{cyl})}{\rho}} \tag{1.5}$$

Wherein:

$C_{inj}$: a fuel injector flow coefficient (constant).

$A_{inj}$: a fuel injector equivalent cross-sectional area (constant)

$P_{cyl}$: a compressed air pressure in the cylinder (constant)

2. Model linearization

As known by those skilled in the art, a mathematic model of the control system is a mathematic expression, a graph expression or a digital expression describing relationship between physical quantities (or variables) in the system, i.e., a mathematic expression (or digital or graph expression) describing the system performance. The mathematic model of the control system may be in many forms, there may be different methods of building the mathematic model of the system, and different model forms apply to different analyzing methods. Theoretically, no mathematic expression can accurately (absolutely accurately) describe a system because theoretically any system is non-linear, time variant and has distributed parameters, and has random factors, and the more complicated the system is, the more complicated situations are.

Two processing methods are often used to linearize the non-linear system: a method of neglecting and not calculating constants, and a tangent method or small deviation method. The tangent method or small deviation method is particularly adapted for a non-linear characteristic function having continuous variance, and substantively involves replacing the non-linear characteristics with a segment of straight line in very small scope. Processing in mathematic is taking a Taylor expansion type linear item thereof.

Suppose the non-linear function $y=f(x)$ having continuous variance takes a balance state A as an operation point, to correspond to $y_0=f(x_0)$. When $X=x_0+\Delta x$ has $y=y_0+\Delta y$, suppose $y=f(x)$ be continuously differentiable at the point $(x_0,y_0)$, a Taylor series expansion nearby the point $(x_0,y_0)$ is:

$$y = f(x) = f(x_0) + \left(\frac{df(x)}{dx}\right)x_0(x-x_0) + \frac{1}{2!}\left(\frac{d^2f(x)}{dx^2}\right)x_0(x-x_0)^2 + \dots .$$

When an increment $(X-x_0)$ is very small, the high order power item is omitted, and the following is obtained:

$$y - y_0 = f(x) - f(x_0) = \left(\frac{df(x)}{dx}\right)x_0(x-x_0)$$

then $$\Delta y = K\Delta x\left(\Delta y = y - y_0 \quad \Delta x = x - x_0 \quad K = \left(\frac{df(x)}{dx}\right)x_0\right)$$

If the increment symbol $\Delta$ is omitted, a linear equation $y=Kx$ (K is a proportionality factor and it is a slope of $f(x)$ at the point A) of the function at the balance point A is obtained. Regarding a multivariate function, the situation is similar and will not be detailed here.

Based on this, the physical model may be linearly expanded nearby the balance point of the fuel system in the present invention to obtain the linearized physical model and thereby simplify operation. Those skilled in the art appreciate that the increment symbol $\Delta$ may be omitted with respect to the linearized physical model nearby the balance point.

2.1 Linearized physical model of the high-pressure common-rail fuel system

The following is obtained by linearizing the common-rail system model nearby the balance point (respectively represented by $P_p^*$ and $P_r^*$) of the fuel pressure $P_p$ and $P_r$:

$$\dot{P}_p = a_1P_p + a_2P_r + a_3\theta + a_4h + a_5u \tag{2.1}$$

$$\dot{P}_r = b_1P_p + b_2P_r \tag{2.2}$$

Wherein:

$$a_1 = \frac{1}{V_p}\left[\frac{\partial\beta_p}{\partial P_p}\left(C_u u\sqrt{\frac{2(P_u - P_p^*)}{\rho}} - C_rA_r\sqrt{\frac{2(P_p^* - P_r^*)}{\rho}} + A_p\vartheta\right) - \beta_p\left(\frac{C_u u}{\sqrt{2\rho(P_u - P_p^*)}} + \frac{C_rA_r}{\sqrt{2\rho(P_p^* - P_r^*)}}\right)\right]$$

$$a_2 = \frac{\beta_pC_rA_r}{V_p\sqrt{2\rho(P_p^* - P_r^*)}}$$

$$a_3 = \frac{\beta_pA_p}{V_p}$$

$$a_4 = \frac{\beta_pA_p}{V_p^2}\left(C_u u\sqrt{\frac{2(P_u - P_p^*)}{\rho}} - C_rA_r\sqrt{\frac{2(P_p^* - P_r^*)}{\rho}} + A_p\vartheta\right)$$

$$a_5 = \frac{\beta_pC_u}{V_p}\sqrt{\frac{2(P_u - P_p^*)}{\rho}}$$

-continued $$b_1 = \frac{\beta_rC_rA_r}{V_r\sqrt{2\rho(P_p^* - P_r^*)}}$$

$$b_2 = \frac{1}{V_r}\left[\frac{\partial\beta_r}{\partial P_r}\left(C_rA_r\sqrt{\frac{2(P_p^* - P_r^*)}{\rho}} - C_{inj}A_{inj}\sqrt{\frac{2(P_r^* - P_{cyl})}{\rho}}\right) - \beta_r\left(\frac{C_rA_r}{\sqrt{2\rho(P_p^* - P_r^*)}} + \frac{C_{inj}A_{inj}}{\sqrt{2\rho(P_r^* - P_{cyl})}}\right)\right]$$

e coefficients $a_1$, $a_2$, $a_3$, $a_4$, $a_5$, $b_1$, $b_2$ in the above formula may be obtained by using the state of the balance point.

Since the fuel pressure $P_p$ in the plunger pump cavity may not be directly measured, the present invention designs an apparatus for observing fuel pressure, which will be described with reference to FIG. 3.

Figure 3:
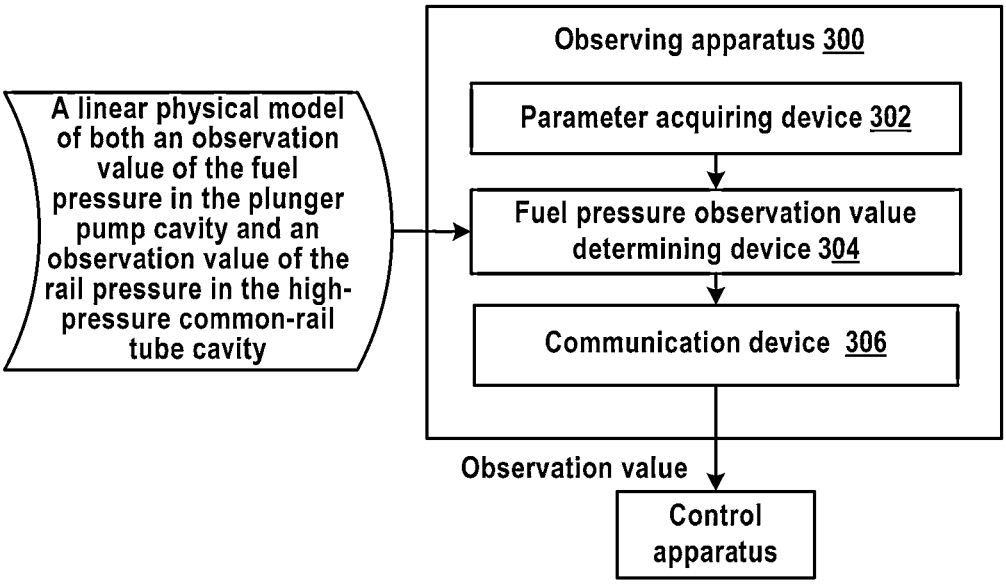
FIG. 3 illustrates a block diagram of an apparatus for observing a fuel pressure according to an embodiment of the present invention.

FIG. 3 illustrates a block diagram of an apparatus for observing the fuel pressure according to an embodiment of the present invention. As shown in FIG. 3, the observing apparatus 300 may comprises a parameter acquiring device 302 configured to acquire the plunger movement linear speed $\theta$, a lift h of the high-pressure fuel injection pump plunger, the equivalent cross-sectional area u of the fuel quantity metering valve and the measurement value $P_r$ of the rail pressure of the high-pressure common-rail tube cavity; and a fuel pressure observation value determining device 304 coupled to the parameter acquiring device 302 and configured to, based on the acquired measurement value, determine the observation value of the plunger pump cavity fuel pressure by using the linear model of both the observation value of the fuel pressure of the plunger pump cavity and the observation value of the rail pressure of the high-pressure common-rail tube cavity.

Those skilled in the art appreciate that various device may be employed to design the linear model of both the observation value of the fuel pressure of the plunger pump cavity and the observation value of the high-pressure common-rail tube cavity. One of the embodiments is given as follows.

Suppose the observation value of the fuel pressure in the fuel plunger pump be $\hat{P}_p$, the observation value of the fuel pressure in the high-pressure common-rail tube cavity be $\hat{P}_r$, and the measurement value of the fuel pressure in the high-pressure common rail tube cavity be $P_r$. A suitable $L=[L_p\ L_p]$ is selected so that the following formulas are stable and convergent:

$$\dot{\hat{P}}_p = a_1\hat{P}_p + a_2\hat{P}_r + a_3\theta + a_4h + a_5u + L_p(\hat{P}_r - P_r) \tag{2.3}$$

$$\dot{\hat{P}}_r = +b_1\hat{P}_p + b_2\hat{P}_r + L_r(\hat{P}_r - P_r) \tag{2.4}$$

Whereby the formulas (2.3) and (2.4) have a solution, i.e., a value of a state observation quantity $\hat{P}_p$, or a value of both $\hat{P}_p$ and $\hat{P}_r$ may be obtained.

It can be seen that according to some embodiments of the present invention, the fuel pressure observation value determining device 304 may be further configured to, based on the acquired measurement value, determine the observation value $\hat{P}_r$ of the rail pressure of the high-pressure common rail tube cavity by using the linear model of both the observation value of the fuel pressure of the plunger pump cavity and the observation value of the rail pressure of the high-pressure common-rail tube cavity.

In addition, the observing apparatus 300 may further comprise a communication device 306 which is coupled to the fuel pressure observation value determining device 304 and configured to provide the control apparatus with a fuel pressure observation value $\hat{P}_p$ (or both of $\hat{P}_p$ and $\hat{P}_r$) for use by the linear physical model of the fuel quantity metering valve equivalent cross-sectional area.

According to some embodiments of the present invention, an advantage of providing both of $\hat{P}_p$ and $\hat{P}_r$, (namely, the linear physical model may utilize observation values of the two values) lies in that so doing can improve accuracy of the linear physical model of the equivalent cross-sectional area. According to some other embodiments according to the present invention, an advantage of only providing the observation value $\hat{P}_p$ lies in that $\hat{P}_r$ needn't be solved and operation time is shortened.

Certainly, those skilled in the art may appreciate that the above only illustrates one embodiment of estimating the observation value $\hat{P}_p$ of the fuel pressure of the plunger pump cavity (or both of $\hat{P}_p$ and $\hat{P}_r$). Those skilled in the art may, based on the idea of the present invention, make any modifications to the above embodiment, and these modifications should all fall within the protection scope of the present invention. Alternatively, in the case that the operation conditions of the engine do not change, it is unnecessary to re-calculate the observation value $\hat{P}_p$ of the fuel pressure of the plunger pump cavity (or both of $\hat{P}_p$ and $\hat{P}_r$) upon determining the fuel quantity metering valve equivalent cross-sectional area each time, and instead, the value may be recorded and used repeatedly to reduce the operation pressure and improve real time of the system.

After the observation value $\hat{P}_p$ of the fuel pressure of the plunger pump cavity (or both of $\hat{P}_p$ and $\hat{P}_r$) is determined, the linear physical model of the fuel quantity metering valve equivalent cross-sectional area is derived below based on the formulas (2.1) and (2.2).

First, a rail pressure target value of the high-pressure common-rail tube cavity is defined as $P_{r,des}$, an actual rail pressure measurement value is $P_r$, and an error between the actual rail pressure measurement value and the rail pressure target value is $e=P_r-P_{r,des}$.

Then:

$$P_r=e+P_{r,des}, \dot{e}=\dot{P}_r, \ddot{e}=\ddot{P}_r$$

Whereby the linear physical model of the fuel quantity metering valve equivalent cross-sectional area is:

$$u=\frac{1}{b_1a_5}\left[(b_2a_1-b_1a_2)P_{r,des}-b_1a_3\vartheta-b_1a_4h+k_pe+k_i\int e+k_d\dot{e}\right] \tag{2.5}$$

$$\text{If } \ddot{e}-(a_1+b_2+k_d)\dot{e}+(a_1b_2-b_1a_2-k_p)e-k_i\int e=0,$$

By selecting proper $k_p$, $k_i$ and $k_d$ gains, the following may be determined:

When $t\rightarrow\infty$, $e\rightarrow 0$.

It is known from the formula (2.5) that a feedforward control item of u is:

$$u_{FF}=\frac{1}{b_1a_5}[(b_2a_1-b_1a_2)P_{r,des}-b_1a_3\vartheta-b_1a_4h] \tag{2.6}$$

A feedback control item is:

$$u_{FB}=\frac{1}{b_1a_5}\left(k_pe+k_i\int e+k_d\dot{e}\right) \tag{2.7}$$

Figure 6:
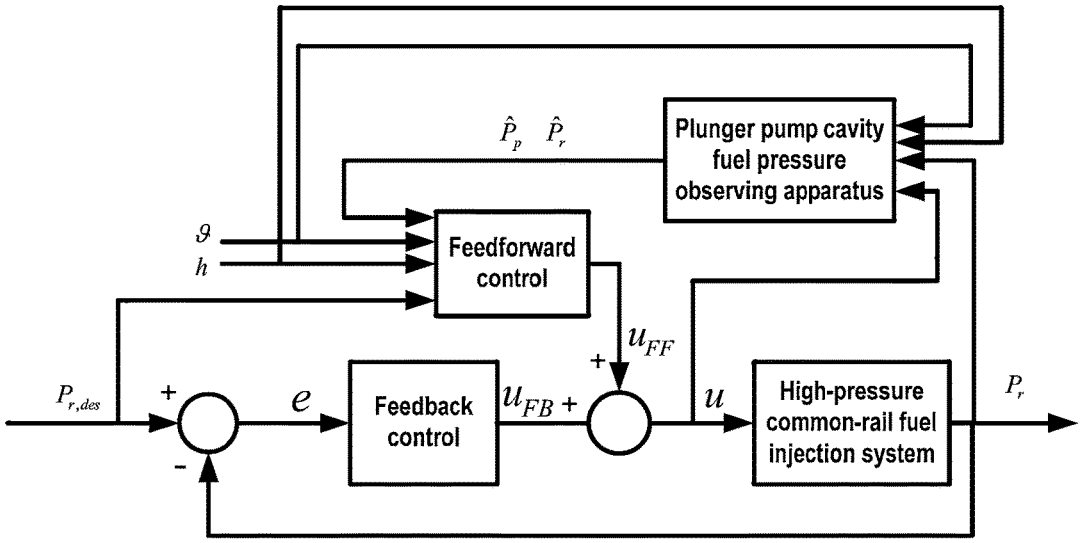
FIG. 6 illustrates an example block diagram of controlling a high-pressure common-rail fuel system using a linear physical model according to an embodiment of the present invention.

Whereby the linear physical model of the fuel quantity metering valve equivalent cross-sectional area is obtained. As shown in FIG. 6, a block diagram of controlling of a high-pressure common-rail fuel system using the linear physical model to determine the fuel quantity metering valve equivalent cross-sectional area is illustrated.

Specifically, as shown in FIG. 6, according to the linear physical model of the fuel quantity metering valve equivalent cross-sectional area, the feedforward control item is related to the $P_{r,des}$, h and θ, wherein $\hat{P}_p$ and $\hat{P}_r$ need to be known to calculate respective coefficients. Certainly, as stated above, it is possible that only $\hat{P}_p$ needs to be known.

Still as can be seen from FIG. 6, the values of $\hat{P}_p$ and $\hat{P}_p$ are related to u, h, θ and $P_r$.

Further as can be seen from FIG. 6, the feedback control item is related to the error e, namely, related to $P_{r,des}$ and $P_r$.

As known by those skilled in the art, the linear physical model may only comprise the feedforward control item or the feedback control item, or comprise a combination thereof. The present invention is not limited to this.

Certainly, it should be appreciated that what is presented above is only an embodiment of deriving the linear physical model. Diverse variations of the model are possible. For example, under some operation conditions, one or more of the above-mentioned aspects may not be considered in the physical model, and/or a new aspect regarding the high-pressure fuel system of the engine may be added. In fact, based on the above suggestions and teaching presented by the present invention, those skilled in the art may, in combination with specific demands and conditions, design and implement any appropriate linear physical model to characterize the fuel quantity metering valve equivalent cross-sectional area.

Further referring to FIG. 2, the control apparatus 200 may further comprise a signal generating device 206 coupled to the fuel quantity metering valve equivalent cross-sectional area determining device 204 and configured to generate a driving signal for controlling the equivalent cross-sectional area of the fuel quantity metering valve based on the determined fuel quantity metering valve equivalent cross-sectional area.

Figure 4:
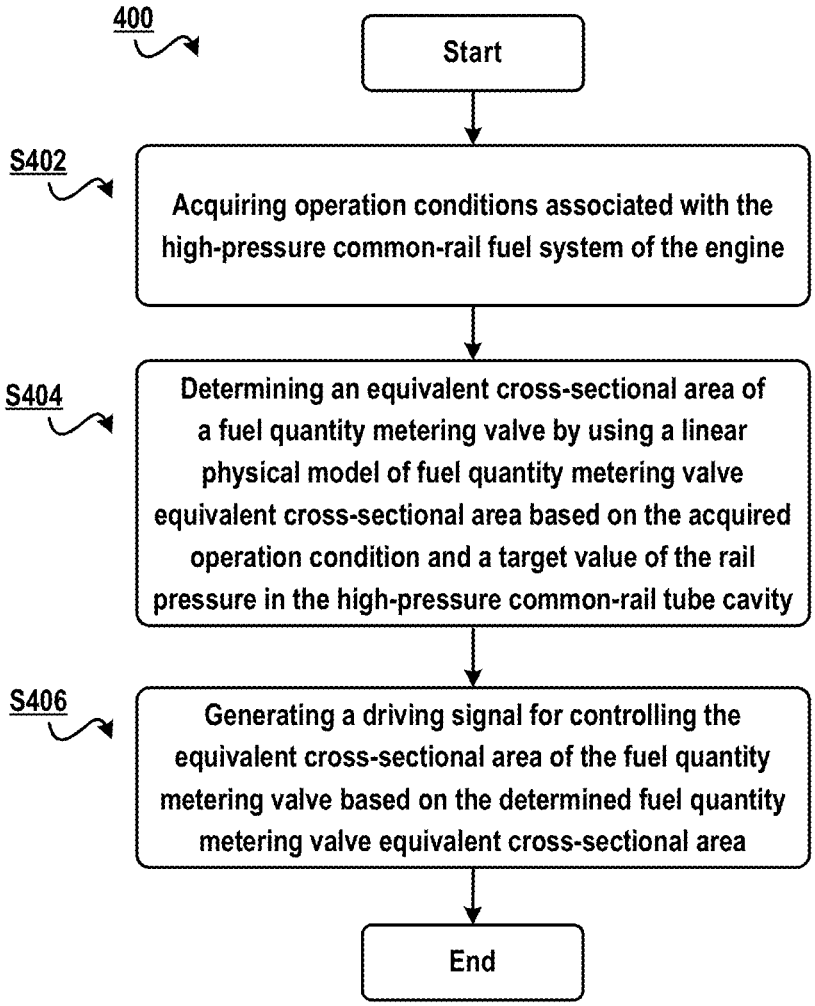
FIG. 4 illustrates a schematic flow chart of a method for controlling a rail pressure of a high-pressure common-rail tube cavity of a high-pressure common-rail fuel system of an engine according to an embodiment of the present invention.

Then, reference is made to FIG. 4 to describe a flow chart of a method 400 for controlling a rail pressure of a high-pressure common-rail tube cavity of a high-pressure common-rail fuel system of an engine according to an embodiment of the present invention.

As shown in FIG. 4, the method 400 for controlling the rail pressure of the high-pressure common-rail tube cavity of the high-pressure common-rail fuel system of the engine may comprise: acquiring operation conditions associated with the high-pressure common-rail fuel system of the engine (S402); determining an equivalent cross-sectional area of a fuel quantity metering valve by using a linear physical model of fuel quantity metering valve equivalent cross-sectional area based on the acquired operation condition and a target value of the rail pressure of the high-pressure common-rail tube cavity (S404); generating a driving signal for controlling the equivalent cross-sectional area of the fuel quantity metering valve based on the determined fuel quantity metering valve equivalent cross-sectional area (S406).

Figure 5:
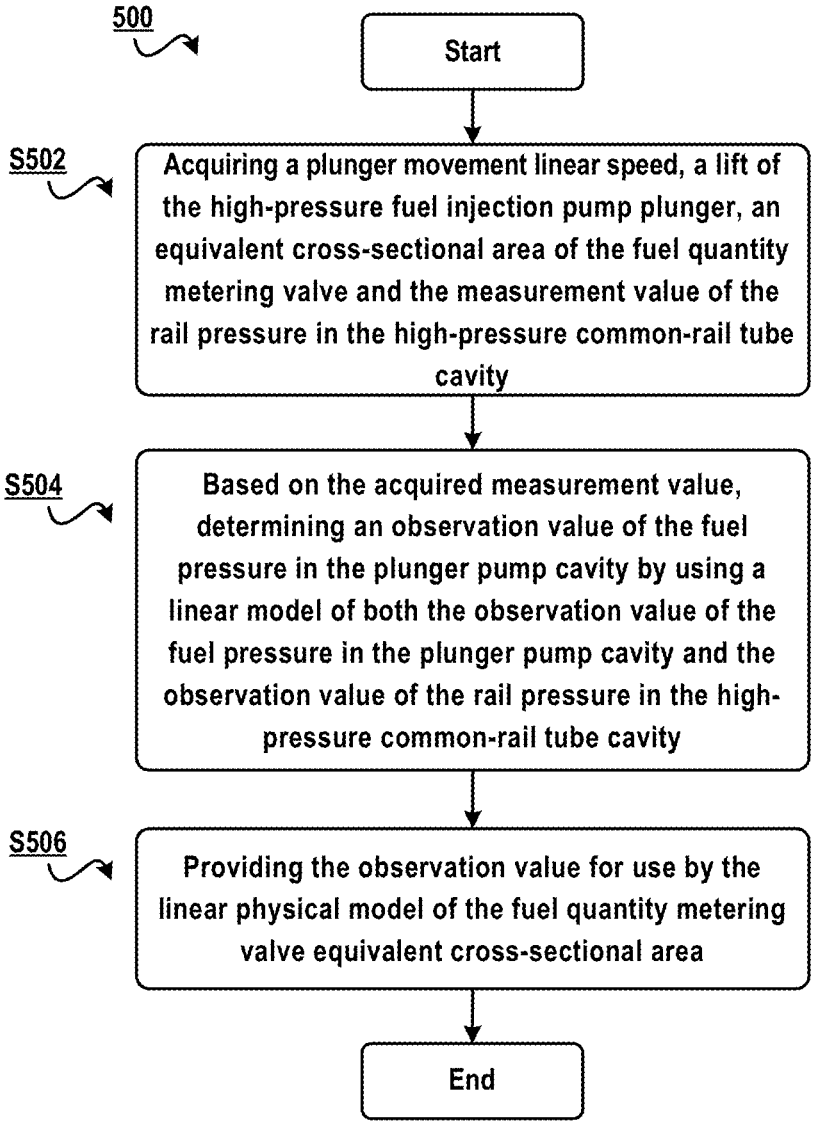
FIG. 5 illustrates a schematic flow chart of a method for observing a fuel pressure according to an embodiment of the present invention.

Then reference is made to FIG. 5 to describe a flow chart of a method 500 for observing a fuel pressure according to an embodiment of the present invention.

As shown in FIG. 5, the method 500 may comprise: acquiring the plunger movement linear speed, a lift of the high-pressure fuel injection pump plunger, the equivalent cross-sectional area of the fuel quantity metering valve and the measurement value of the rail pressure of the high-pressure common-rail tube cavity (S502); based on the acquired measurement value, determining the observation value of the plunger pump cavity fuel pressure by using the linear model of both the observation value of the fuel pressure in the plunger pump cavity and the observation value of the rail pressure of the high-pressure common-rail tube cavity (S504); and providing the observation value for use by the linear physical model of the fuel quantity metering valve equivalent cross-sectional area (S506).

According to some embodiments of the present invention, the step 504 may further comprise determining the observation value of the rail pressure of the high-pressure common-rail tube cavity by using the linear model of both the observation value of the fuel pressure of the plunger pump cavity and the observation value of the rail pressure of the high-pressure common-rail tube cavity.

It may be appreciated that the steps recited in the method 400 and the method 500 are respectively corresponding to and consistent with device of the control apparatus 200 and the observing apparatus 300 shown in FIG. 2 and FIG. 3. Hence, operations, functions and/or features as described with reference to respective device of the control apparatus 200 and the observing apparatus 300 are also adapted for respective steps of the method 400 and the method 500. Furthermore, the respective steps recited in the method 400 and method 500 may be executed in different orders and/or executed in parallel.

Additionally, it should be appreciated that the method 400 and method 500 described with reference to FIG. 4 and FIG. 5 may be implemented by a computer program product. For example, the computer program product may comprise at least one computer-readable storage medium having a computer-readable program code portion stored thereon. When the computer-readable code portion is executed by a processor, it is used to execute the steps of the method 400 and the method 500.

The embodiments of the present invention may be implemented in hardware, software or the combination thereof. The hardware part can be implemented by a special logic; the software part can be stored in a memory and executed by a proper instruction execution system such as a microprocessor or a design-specific hardware. Those having ordinary skill in the art may understand that the above apparatus and method may be implemented with a computer-executable instruction and/or in a processor controlled code, for example, such code is provided on a bearer medium such as a magnetic disk, CD, or DVD-ROM, or a programmable memory such as a read-only memory (firmware) or a data bearer such as an optical or electronic signal bearer. The apparatus and its modules in the present invention may be implemented by hardware circuitry of a programmable hardware device such as a very large scale integrated circuit or gate array, a semiconductor such as logical chip or transistor, or a field-programmable gate array, or a programmable logical device, or implemented by software executed by various kinds of processors, or implemented by combination of the above hardware circuitry and software, e.g., firmware.

It should be noted that although a plurality of device or sub-device of the control apparatus and the observation apparatus have been mentioned in the above detailed depictions, such partitioning is merely non-compulsory. In actuality, according to the embodiments of the present invention, the features and functions of the above described two or more device may be embodied in one device. In turn, the features and functions of the above described one device may be further embodied by a plurality of device.

Besides, although operations of the present methods are described in a particular order in the drawings, it does not require or imply that these operations must be performed according to this particular sequence, or a desired outcome can only be achieved by performing all shown operations. On the contrary, the execution order for the steps as depicted in the flowcharts may be varied. Additionally or alternatively, some steps may be omitted, a plurality of steps may be merged into one step, and/or a step may be divided into a plurality of steps for execution.

Although the present invention has been depicted with reference to a plurality of specific embodiments, it should be appreciated that the present invention is not limited the disclosed embodiments. On the contrary, the present invention intends to cover various modifications and equivalent arrangements included in the spirit and scope of the appended claims. The scope of the appended claims meets the broadest explanations and covers all such modifications and equivalent structures and functions.

What is claimed is:

1. An apparatus for controlling a rail pressure of a high-pressure common-rail tube cavity of a high-pressure common-rail fuel system of an engine, characterized in that the apparatus comprises:

an operation condition acquiring device programmed to acquire operation conditions associated with the high-pressure common-rail fuel system of the engine;

a fuel quantity metering valve equivalent cross-sectional area determining device coupled to the operation condition acquiring device and programmed to determine a target equivalent cross-sectional area of the fuel quantity metering valve by using a linear physical model of fuel quantity metering valve equivalent cross-sectional area based on the acquired operation condition and a target value of the rail pressure of the high-pressure common-rail tube cavity, wherein the linear physical model is generated by modeling a flow of a flow metering unit, a plunger pump cavity pressure, a flow from the plunger pump cavity to the high-pressure common-rail tube cavity, the rail pressure of the high-pressure common-rail tube cavity, and a flow injected by a fuel injector to a cylinder;

a signal generating device coupled to the fuel quantity metering valve equivalent cross-sectional area determining device and programmed to generate a driving signal for controlling an actual equivalent cross-sectional area of the fuel quantity metering valve based on the determined target equivalent cross-sectional area.

2. The apparatus according to claim 1, characterized in that, the operation conditions comprises a lift of a high pressure fuel injection pump plunger and a measurement value of its linear speed.

3. The apparatus according to claim 1, characterized in that, the operation conditions comprises an actual rail pressure measurement value of the high-pressure common-rail tube cavity.

4. The apparatus according to claim 1, characterized in that, a volume of the plunger pump cavity is related to a maximum volume of the plunger pump cavity and a lift of the high-pressure fuel injection pump plunger relevant to a camshaft rotation angle;

a plunger movement linear speed is related to the lift of the high-pressure fuel injection pump plunger, the camshaft rotation angle and a camshaft rotation speed;

an observation value of the plunger pump cavity pressure is related to a measurement value of the rail pressure in the high-pressure common-rail tube cavity, the actual equivalent cross-sectional area of the fuel quantity metering valve, the lift of the high-pressure fuel injection pump plunger and the plunger movement linear speed.

5. An apparatus for observing a fuel pressure, characterized in that the apparatus comprises:

a parameter acquiring device programmed to acquire measurement values of a plunger movement linear speed, a lift of a high-pressure fuel injection pump plunger, an actual equivalent cross-sectional area of a fuel quantity metering valve and a rail pressure of a high-pressure common-rail tube cavity;

a fuel pressure observation value determining device coupled to the parameter acquiring device and programmed to, based on the acquired measurement values, determine an observation value of the fuel pressure in the plunger pump cavity by using a linear model of both the observation value of the fuel pressure in the plunger pump cavity and an observation value of the rail pressure of the high-pressure common-rail tube cavity;

a communication device which is coupled to the fuel pressure observation value determining device and programmed to provide the observation value for use by a linear physical model of the equivalent cross-sectional area of the fuel quantity metering valve to determine a target equivalent cross-sectional area of the fuel quantity metering valve, wherein the linear physical model is generated by modeling a flow of a flow metering unit, a plunger pump cavity pressure, a flow from the plunger pump cavity to the high-pressure common-rail tube cavity, the rail pressure of the high-pressure common-rail tube cavity, and a flow injected by a fuel injector to a cylinder; and a signal generating device coupled to the communication device programmed to generate a driving signal for controlling an equivalent cross-sectional area of the fuel quantity metering valve based on the determined target equivalent cross-sectional area.

6. The apparatus according to claim 5, characterized in that, the fuel pressure observational value determining device is further programmed to, based on the acquired measurement value, determine the observation value of the rail pressure of the high-pressure common-rail tube cavity by using the linear model of both the observation value of the fuel pressure in the plunger pump cavity and the observation value of the rail pressure of the high-pressure common-rail tube cavity.

7. A method for controlling a rail pressure of a high-pressure common-rail tube cavity of a high-pressure common-rail fuel system of an engine, characterized in that the method comprises:

acquiring operation conditions associated with the high-pressure common-rail fuel system of the engine;

determining a target equivalent cross-sectional area of a fuel quantity metering valve by using a linear physical model of the fuel quantity metering valve equivalent cross-sectional area based on the acquired operation condition and a target value of the rail pressure of the high-pressure common-rail tube cavity, wherein the linear physical model is generated by modeling a flow of a flow metering unit, a plunger pump cavity pressure, a flow from the plunger pump cavity to the high-pressure common-rail tube cavity, the rail pressure of the high-pressure common-rail tube cavity, and a flow injected by a fuel injector to a cylinder;

generating a driving signal for controlling the actual equivalent cross-sectional area of the fuel quantity metering valve based on the determined target equivalent cross-sectional area of the fuel quantity metering valve.

8. The method according to claim 7, characterized in that, the operation conditions comprises a lift of a high pressure fuel injection pump plunger and a measurement value of its linear speed.

9. The method according to claim 7, characterized in that, the operation conditions comprises an actual rail pressure measurement value of the high-pressure common-rail tube cavity.

10. The method according to claim 7, characterized in that, a volume of the plunger pump cavity is related to a maximum volume of the plunger pump cavity and a lift of the high-pressure fuel injection pump plunger relevant to a camshaft rotation angle;

a plunger movement linear speed is related to the lift of the high-pressure fuel injection pump plunger, the camshaft rotation angle and a camshaft rotation speed;

an observation value of the plunger pump cavity pressure is related to a measurement value of the rail pressure in the high-pressure common-rail tube cavity, the actual equivalent cross-sectional area of the fuel quantity metering valve, the lift of the high-pressure fuel injection pump plunger and the plunger movement linear speed.

11. A method for observing a fuel pressure, characterized in that the method comprises:

acquiring measurement values of a plunger movement linear speed, a lift of a high-pressure fuel injection pump plunger, an actual equivalent cross-sectional area of a fuel quantity metering valve and a rail pressure of the high-pressure common-rail tube cavity;

based on the acquired measurement values, determining an observation value of the fuel pressure in the plunger pump cavity by using a linear model of both the observation value of the fuel pressure in the plunger pump cavity and an observation value of the rail pressure of the high-pressure common-rail tube cavity;

providing the observation value for use by a linear physical model of the equivalent cross-sectional area of the fuel quantity metering valve to determine a target equivalent cross-sectional area of the fuel quantity metering valve, wherein the linear physical model is generated by modeling a flow of a flow metering unit, a plunger pump cavity pressure, a flow from the plunger pump cavity to the high-pressure common-rail tube cavity, the rail pressure of the high-pressure common-rail tube cavity, and a flow injected by a fuel injector to a cylinder; and a driving signal for controlling the actual equivalent cross-sectional area of the fuel quantity metering valve based on the determined target equivalent cross-sectional area of the fuel quantity metering valve.

12. The method according to claim 11, characterized in that the step of acquiring the measurement value further comprises determining the observation value of the rail pressure of the high-pressure common-rail tube cavity by using the linear model of both the observation value of the fuel pressure in the plunger pump cavity and the observation value of the rail pressure of the high-pressure common-rail tube cavity.

* * * * *